US006328824B1

(12) United States Patent
Mareuse et al.

(10) Patent No.: US 6,328,824 B1
(45) **Date of Patent: *Dec. 11, 2001**

(54) SHEET WITH ALUMINUM COATING THAT IS RESISTANT TO CRACKING

(75) Inventors: Didier Mareuse, Nogent sur Oise; Thérèse Six, Montataire; Pierre Jean Krauth, Yutz, all of (FR)

(73) Assignee: Sollac, Puteaux (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/256,994

(22) Filed: Feb. 25, 1999

(30) Foreign Application Priority Data

Feb. 25, 1998 (FR) ..... 98 02265

(51) Int. Cl.[7] ..... C23C 2/28
(52) U.S. Cl. ..... 148/523; 148/531; 148/535
(58) Field of Search ..... 148/523, 531, 148/535, 537

(56) References Cited

U.S. PATENT DOCUMENTS 4,526,103 * 7/1985 Kubota et al. ..... 148/531
5,023,113 * 6/1991 Boston et al. ..... 148/531
5,562,999 * 10/1996 Grunne et al. ..... 148/537

FOREIGN PATENT DOCUMENTS 0 710 732 5/1996 (EP) .
60-48570 * 10/1985 (JP) ..... 148/531

OTHER PUBLICATIONS

Ulrich Etzold, et al; "New developments in the production and application of hot–dip aluminized steel sheet"; vol. 111, No. 12, pp. 111–116; Dec. 16, 1991 (with English translation).
Higuchi Yukinobu; "Heat Resistant Aluminized Steel Sheet Retaining its Luster"; Patent Abstracts of Japan, vol. 010, No. 296; Oct. 8, 1986; Japan 61113754; May 31, 1986.

* cited by examiner

*Primary Examiner*—George Wyszomierski
(74) *Attorney, Agent, or Firm*—Oblon, Spivak, McClelland, Maier & Neustadt, P.C.

(57) ABSTRACT

A metallic sheet with an aluminum coating, the coating having an internal layer of iron/aluminum/silicon alloys, and an external layer, thicker, of an aluminum-based phase and secondarily of phases in the form of needles or elongated lamellae. The projection of the length of all needles or lamellae in a direction perpendicular to the plane of the external layer is less than the thickness of this layer. This structure, which is obtained by a thermal treatment of the external layer at a temperature of 570–660° C., notably for less than 15 sec, considerably decreases the risks of cracking.

18 Claims, 3 Drawing Sheets

SHEET WITH ALUMINUM COATING THAT IS RESISTANT TO CRACKING

BACKGROUND OF THE INVENTION

1. Field of the Invention

The invention concerns aluminum coated metallic sheets.

2. Background of the Invention

The application of a metal coating based on aluminum onto a sheet is a means that is routinely used to protect a sheet made of steel against corrosion, notably in the case where the temperature of use of this sheet exceeds approximately 400° C. The thickness of the metallic coating in question is generally 5–100 $\mu$m. Several methods are known to apply to metallic coating onto a sheet.

For example, one can proceed by laminating a film of aluminum onto the sheet to be coated, but this method is expensive. Alternatively, one can proceed by immersing the sheet in a liquid bath based on aluminum.

Figure 4:
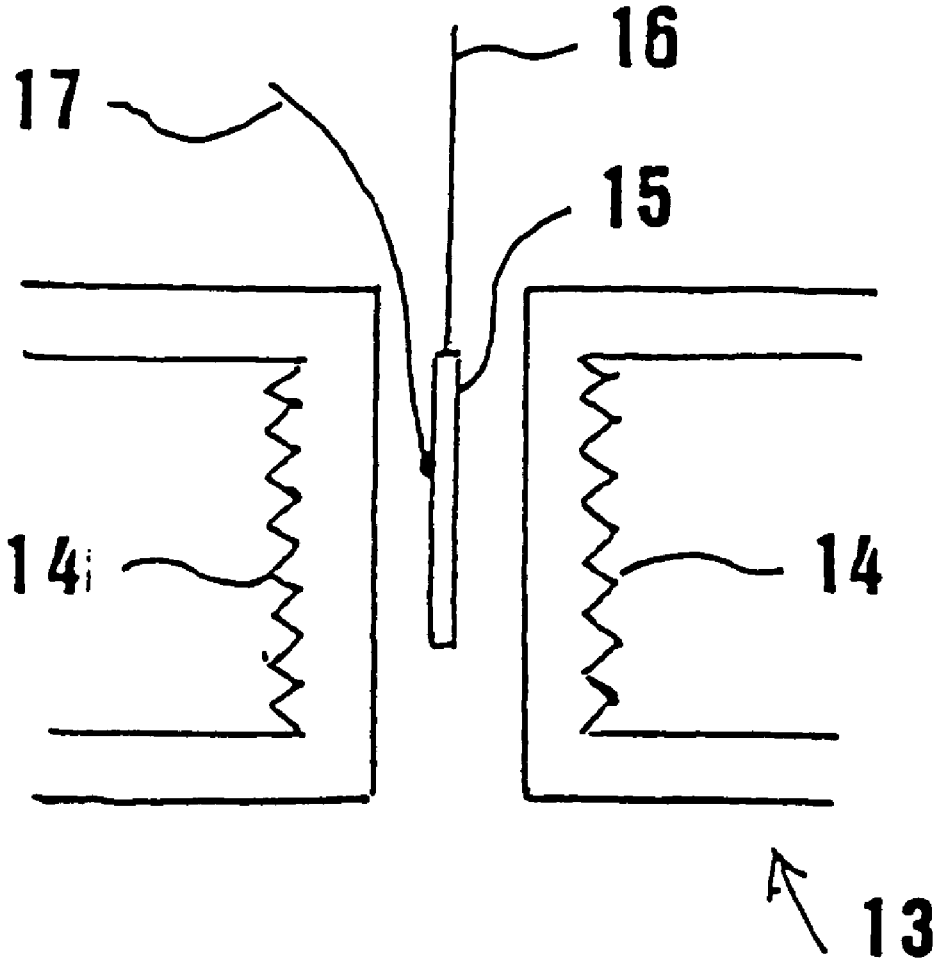

When the method by immersion is used, as described in the article in the journal STAHL and EISEN, Vol. 111, No. 12, Dec. 12, 1991, pp. 111–116 (THYSSEN Forschung, Duisburg), notably in FIG. 4 and in the middle of page 112, (incorporated herein by reference) the coating comprises:

an interface or internal layer consisting essentially of one or more alloys based on iron and aluminum, and an external layer comprising essentially a principal phase based on aluminum, and secondarily, other phases in the form of needles or elongated lamellae dispersed in said principal phase; the article cites the presence of eutectic phases between the solidified aluminum dendrites.

Since, seen in cross section, lamellae are in the form of needles, it is difficult to distinguish, in practice, needles from lamellae.

The internal layer consisting of an alloy has a fragile behavior, and therefore attempts are generally made to limit its thickness.

To limit the thickness of this layer of alloy, immersion baths are generally used which contain a compound which inhibits alloying between the aluminum and the steel.

Silicon is the most frequent inhibitor of alloying used; to be effective, its concentration by weight must generally be larger than 6% in the immersion bath.

Other known means exist to limit the thickness of this layer of alloy, such as using, before the coating, a slight nitration of the surface to be coated, for example, by conducting recrystallization reheating of the steel to be coated in an atmosphere containing traces of ammonia.

Certain aluminum coated sheets can then be subjected to thermal treatments, either to modify their properties, or even in normal usage (for example: thermal screens); it is also important in this situation not to increase the thickness of the internal layer of alloy appreciably.

To limit this risk of growth of the internal layer of alloy during subsequent thermal treatments, it is known to use types of steel containing sufficient contents of free nitrogen (for example, $\geqq 10^{-2}$ wt %); these steels can be renitrided steels; in this regard, reference is made to the following articles, all incorporated herein by reference:

T. Yamada and H. Kawase, presented at the $5^{th}$ "IAVD Meeting" in 1989 (IAVD: "International Society for Vehicle Design").

Y. Hirose and Y. Uchida, in the supplement of the journal "Japan Institute of Metals," No. 3, 1983.

Figure 1:
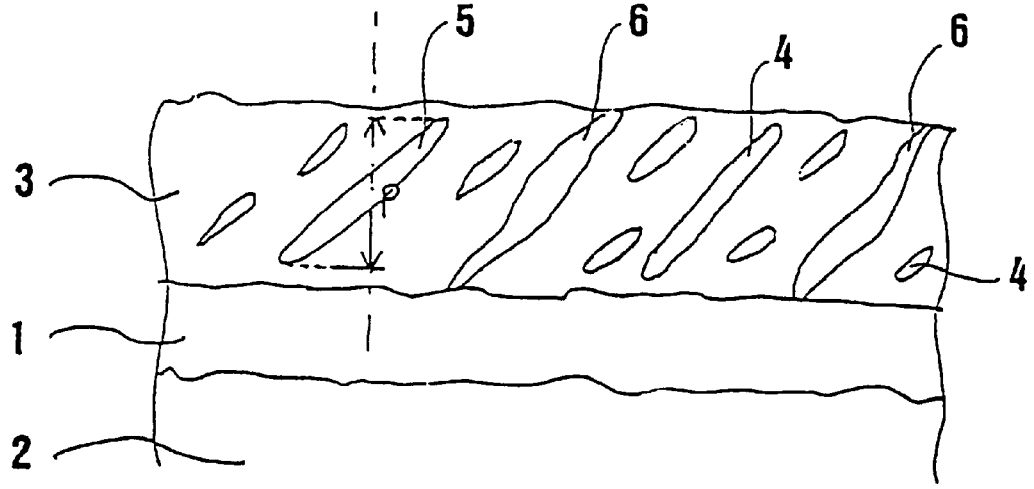
FIG. 1 PRIOR ART

As diagrammatically represented in FIG. 1, when the coating is applied to the immersed material, the coating that one obtains is divided into two principal superposed layers:

an internal layer 1, applied to the steel 2, consisting essentially of one or more alloys based on iron and aluminum, and silicon, notably a so-called τ5 phase and/or a so-called τ6 phase.

an external layer 3 consisting essentially of aluminum in the form of large dendrites; these dendrites are often (but not always) saturated with iron and, optionally, silicon in solid solution.

The internal layer can be subdivided into several sublayers comprising still other phases; at the interface between the internal layer 1 and the steel 2, one can sometimes find a sublayer comprising the following phases: a so-called η phase ($Fe_2Al_5$), a so-called θ phase ($FeAl_3$), and one or more phases based on aluminum nitride; the thickness of this sublayer in generally does not exceed 1 $\mu$m.

At the level of the external layer 3, when a bath is used which contains silicon, phases are generally observed which are richer in silicon and/or iron that the aluminum dendrites; these phases often present an elongated lamellar or needle-shaped form.

As phases 4 with elongated form, the following were identified, for example:

lamellae consisting essentially of silicon, and needles consisting essentially of an intermetallic phase τ6.

The external layer can also comprise alloy phases based on aluminum, silicon and iron, notably of eutectic composition with a low melting point.

The phase τ5 has a hexagonal structure; it is sometimes called $\alpha_H$ or H; the iron content of this phase is generally 29–36 wt %; the silicon content of this phase is generally 6–12 wt %; the remainder consists essentially of aluminum.

The τ6 phase has a monoclinal structure; it is sometimes called β or M; the iron content of this phase is generally 26–29 wt %; the silicon content of this phase is generally 13–16 wt %;

the remainder consists essentially of aluminum.

Table I below recapitulates possible compositions and melting temperatures of the phases present in the coatings which one obtains after immersion in an aluminum coating bath (whose composition and melting temperature are specified in the same Table).

The τ6 phase predominates when the bath contains more than 8 wt % silicon; the inclusions of τ6 phase present an elongated form, whereas the inclusions of τ5 phase generally have a globular shape.

It has been observed that steel sheets coated with an internal layer of alloy based on iron, aluminum and/or silicon and an external layer consisting essentially of aluminum exhibited poor resistance to corrosion after deformation.

Indeed, a deformation, such as a folding, generally causes cracks which open at the surface of the metallic coating; these cracks decrease the corrosion resistance of the steel.

TABLE I

Composition of the Phases of the Coating

| Composition: wt % | Al | Si | Fe | Melting temperature |
|---|---|---|---|---|
| Bath | <91 | >6 | 3 (saturation) | 675° C. (T ° C. immersed) |
| Eutectic | 87 | 12.2 | 0.8 | =577° C. |
| Al dendrites | >98 | ≦1.5 | <0.5 | ~660° C. |
| Si lamellae | Majority component silicon | | | 1412° C. |
| τ6 needles | 55 | 14 | 31 | >577° C. |
| τ5 phase | 55 to 62 | 6 to 12 | 31 to 36 | >577° C. |

OBJECTS OF THE INVENTION

One object of the invention is to provide a metallic sheet whose aluminum-based coating presents better resistance to cracking as a result of deformation, that is a sheet which resists corrosion better after it has been shaped.

SUMMARY OF THE INVENTION

The invention relates to a method for the manufacture of a metallic sheet such as a steel sheet, coated with a metallic coating based on aluminum, divided essentially into two layers:

an internal layer comprising, consisting essentially of, or consisting of one or more alloys based on iron, aluminum and/or silicon, and an external layer which comprises, consists essentially of, or consists of a phase based on aluminum and secondarily of other phases in the form of needles or elongated lamellae distributed in said aluminum-based phase, and having a thickness which is larger than or equal to that of said internal layer of alloy, in which said metallic coating based aluminum is preferably applied by immersion in a liquid bath based on aluminum, preferably characterized in that, after solidification of said applied layer, said sheet is subjected to a thermal treatment which is adapted so as to raise the temperature of at least the external layer to more than 570° C., and less than 660° C., under conditions, notably of duration, heating rate and cooling, which are adapted:

so that the thickness of the external layer remains larger than or equal to that of said internal layer of alloy, and so that the projection of the length of all said needles or lamellae in a direction perpendicular to the plane of said external layer is strictly less than the thickness of this layer.

In this temperature range, above 570° C. and less than 660° C., the melting of the eutectic phase of the external layer is ensured (see the melting temperature of the eutectic portion in Table 1. 557° C.) and the maintenance in the solid state of the aluminum dendrites is ensured (see melting temperature of these dendrites in Table I. 660° C.).

The invention can also present one or more of the following characteristics:

said bath based on aluminum contains at least 6 wt % of silicon, said bath based on aluminum contains at least 8 wt % of silicon, in which case the proportion of $\tau 6$ phase in the coating is larger, at the expense of that of $\tau 5$ phase.

the duration of the thermal treatment, in the phase where said temperature is larger than 570° C., is less than or equal to 15 sec.

The invention also relates to a metallic sheet such as a steel sheet coated with a metallic coating based on aluminum divided primarily into two layers:

an internal layer comprising, consisting essentially of, or consisting of one or more alloys based on iron, aluminum and/or silicon, and an external layer which comprises, consists essentially of, or consisting of a phase based on aluminum and secondarily of other phases in the form of needles or elongated lamellae distributed in said aluminum-based phase, and having a thickness which is larger than or equal to that of said internal layer of alloy, which can be obtained by a method described above, preferably characterized in that the projection of the length of all said needles or lamellae in a direction perpendicular to the plane of said external layer is strictly less than the thickness of this layer at the location of said considered lamellae or needles.

According to this characteristic, by considering the coating of the sheet, and regardless of what the variations in the thickness of the external layer of this coating are, no needle or lamella completely traverses this external layer.

The invention can also present one or more of the following characteristics:

the thickness of said internal layer of alloy is less than or equal to 5 $\mu$m; this smaller thickness makes it possible to limit the risks of the appearance of cracks, said coating comprises compounds based on aluminum nitrides intercalated between the steel of said sheet and said internal layer, the content of free nitrogen of said steel is greater than or equal to $10^{-2}$ wt %.

The presence of nitride at the interface or free nitrogen in the steel blocks or limits the growth of the thickness of the internal layer of alloy.

The invention also relates to a method for shaping a steel sheet coated with a metallic coating based on aluminum, which is subdivided essentially into two layers:

an internal layer comprising, consisting essentially of, or consisting of one or more alloys based on iron, aluminum and/or silicon, and an internal layer which comprises, consists essentially of, or consists of a phase based on aluminum and secondarily other phases in the form of needles or elongated lamellae distributed in said aluminum-based phase, and having a thickness which is larger than or equal to that of said internal layer of alloy, preferably characterized in that, before the shaping step proper of said sheet, said sheet is subjected to a thermal treatment which is adapted so as to increase the temperature of at least the external layer above 570° C. and below 660° C., under conditions, notably of duration, heating rates and cooling rates, which are adapted:

so that the thickness of the external layer remains larger than or equal to that of the internal layer of alloy, and so that the projection of the length of all said needles or lamellae in a direction which is perpendicular to the plane of said external layer is strictly less than the thickness of this layer.

According to an additional characteristic of the invention, the duration of the thermal treatment, in the phase where said temperature is larger than 570° C., is less than or equal to 15 sec.

BRIEF DESCRIPTION OF THE DRAWINGS AND DETAILED DESCRIPTION OF PREFERRED EMBODIMENTS

The invention will be better understood after a reading of the description which follows, which is given as a nonlimiting example, and with reference to the drawings in which:

FIG. 1 is a diagrammatic representation of the structure of the coating layers of an aluminum coated sheet according to the prior art.

Figure 2:
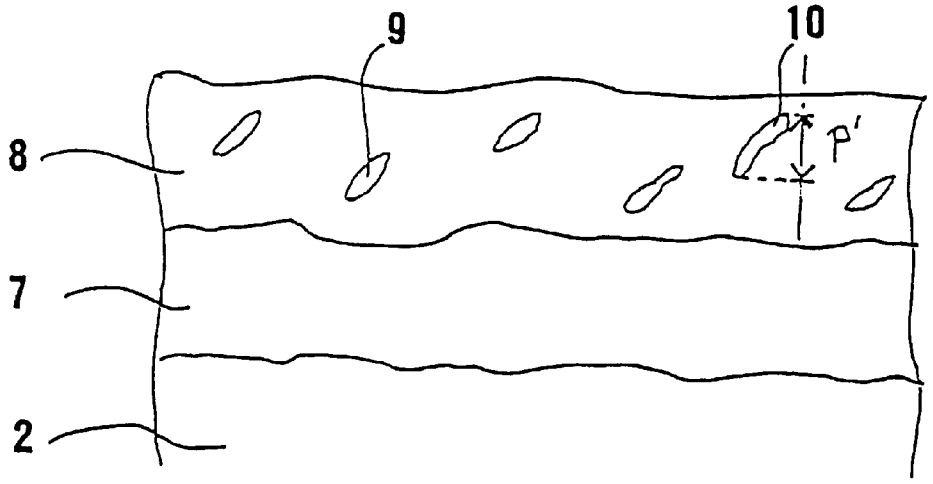
Figure 3:
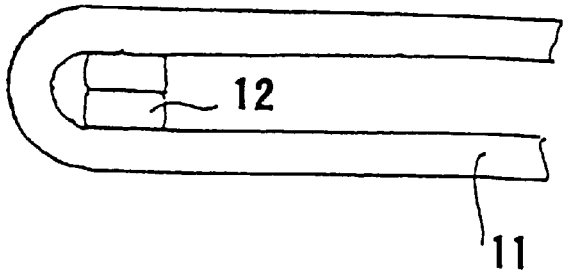
Figure 5:
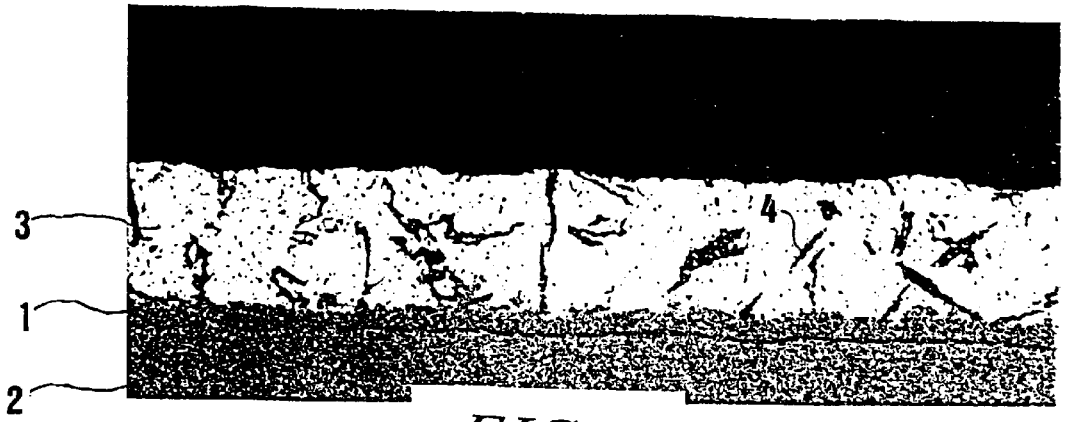
Figure 6:
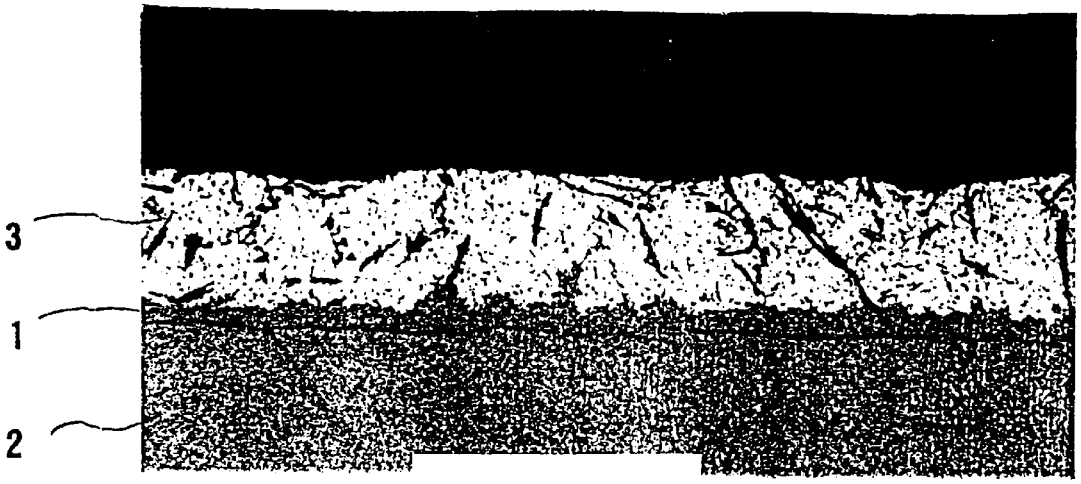

FIG. 2 is a diagrammatic representation of the structure of the coating sheets of an aluminum coated sheet according to the invention, FIG. 3 is an illustration of the procedure for folding sheets in the method for the evaluation of the resistance to cracking, FIG. 4 is a diagrammatic representation of the device used to implement the invention as described in Example 1, and FIGS. 5, 6, on the one hand, and 7, on the other hand, are microphotographs of cross sections illustrating the diagrammatic representations of FIGS. 1 and 2, respectively.

For the application of the metallic coating onto a steel sheet 2, one proceeds with the immersion in a manner which is known in itself, and adapted to the type of metal (steel) used.

The standard steel alumination procedure with immersion generally comprises the following steps:

degreasing and cleaning of the surface of the sheet, reheating of the steel, generally in an inert or reducing atmosphere, directly at the time of removal from reheating, immersion in a liquid aluminum-based bath, and at the time of removal from immersion, centrifugation to regulate the thickness of the coating and cooling to solidify the coating.

With reference to FIGS. 1, 5 and 6, an aluminum coated sheet as described above is then obtained, whose coating is divided essentially into two layers:

an internal layer 1 consisting essentially of one or more alloys based on iron, aluminum and/or silicon, and an external layer 3 consisting essentially of an aluminum-based phase.

(The separation between the steel substrate 2 and layer 1 is marked with a dotted line in FIGS. 5 and 6).

In a manner which is in itself known, the steel type, the conditions of application of the coating and the composition of the bath, notably the content of alloying inhibitor, is adapted so that the thickness of the internal layer of alloy 1 does not exceed that of the external layer 3.

To limit the thickness of this layer 1, silicon is introduced as an alloying inhibitor into the bath, at a concentration larger than or equal to 6 wt %. Preferably, the silicon content is larger than or equal to 8%.

To limit the thickness of this layer 1, the reheating step can be carried out under an atmosphere containing ammonia.

As can be seen in FIGS. 5 and 6, and as represented in FIG. 1, the external layer 3 comprises, in addition to the dendrites based on aluminum, other phases 4 in the form of needles or elongated lamellae distributed in the thickness of this layer between the dendrites.

One observes that a significant proportion of needles and/or lamellae open onto the internal or external surface of the layer, the length of these needles or lamellae "which open" is larger than or equal to the thickness of the layer; more particularly, the projection of the length of these needles or lamellae in a direction perpendicular to the plane of the layer is at least equal to the thickness of this layer.

In FIG. 1, this projection p is shown in the particular case of any lamella, the lamella bearing the reference numeral 5.

For example, one can observe that, for the lamellae bearing the reference numeral 6, the value of this projection corresponds to that of the thickness of the layer 3.

According to the invention, one then proceeds to the next step:

the aluminum coated sheet is subjected to a thermal treatment which is adapted so as to increase the temperature of at least the external layer 3 of the coating above 570° C. and less than 680° C.;

the conditions of the thermal treatment, notably the duration, the heating and cooling rates, are adapted;

so that the thickness of this internal layer of alloy 1 remains less than that of said external layer, and so that the projection of the length of all said needles or lamellae in a direction which is perpendicular to the plane of said external layer is strictly less than the thickness of this layer.

One also observes that the thermal treatment according to the invention has the effect of considerably decreasing the proportion of needles and lamellae in this external layer.

Preferably, the coating based on aluminum is applied so that the thickness of said internal layer of alloy is less than or equal to 5 $\mu$m, and the thermal treatment according to the invention is carried out so that thickness of said internal layer of alloy remains less than or equal to 5 $\mu$m.

The minimum treatment temperature according to the invention corresponds to the melting temperature of the phase of the external layer corresponding to the eutectic Al—Si—Fe composition.

The maximum treatment temperature according to the invention corresponds to the melting temperature of the aluminum dendrites of the external layer.

Preferably, in the phase of the thermal treatment where the temperature is larger than 570° C., the treatment duration is less than 15 sec so as to limit and/or prevent the increase in the thickness of the internal layer of alloy.

This thermal treatment can be carried out under air, even if the coating becomes slightly oxidized at the surface.

Thus, based on these criteria of definition of thermal treatment, one observes that one succeeds in considerably improving the resistance to cracking of the coating.

These observations can be made as follows:

sheet samples 11 are folded to a closed angle (see FIG. 3) by intercalating into the fold of the sheet one or more wedges 12, where each wedge has the thickness of the sheet sample; thus, fold "0T," "1T" and "2T," . . . correspond, respectively, to folding without wedge, with one wedge, and with two wedges; FIG. 3 thus represents a "2T" folding, on a metallographic cross section made from the fold, one then observes, on the outside of the fold, the number of cracks opening at the surface of the coating per millimeter of fold.

More details on this evaluation method can be found in the standard text called "ECCA T7" and entitled, in English "Resistance to Cracking on Bending," published by the "European Coil Coating Association," Standard T7, in the version of Apr. 2, 1996, incorporated herein by reference.

In contrast to the official definition of this standard, the folding was carried out so that the direction of the fold corresponds to that of the lamination of the sheet.

By comparing observations made on aluminum coated sheets before the thermal treatment according to the invention and observations made on the same sheets treated according to the invention, one thus observes, for identical folds, a considerable decrease in the number of cracks per millimeter of fold.

Because of the decrease in the cracks, the resistance to corrosion of the steel of these sheets, after deformation, is considerably increased.

The aluminum coated sheet according to the invention thus exhibits a better resistance to corrosion after shaping, in the sense that the coating protects the steel better.

Figure 7:
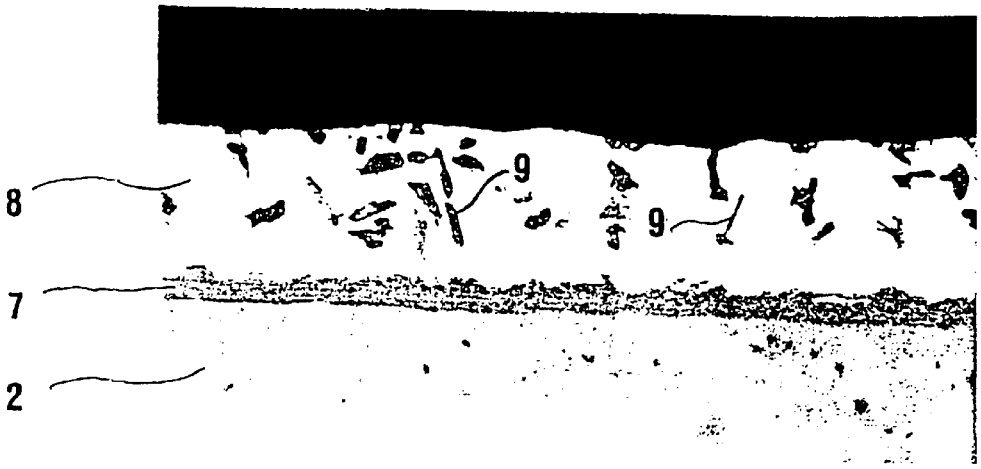

The structure of the coating of the aluminum coated sheet according to the invention is diagrammatically shown in FIG. 2 and represented in FIG. 7; the general structure remains identical; on the steel 2, an internal layer 7 of alloy and an external layer 8 consisting essentially of aluminum.

By comparison with the aluminum coated sheet before treatment (FIGS. 1, 5 and 6), one observes the following principal difference:

the needles and/or lamellae remaining 9 are much shorter than before the thermal treatment, and, thanks to the thermal treatment according to the invention, one successfully achieves the result that the projection of their lengths in a direction perpendicular to the plane of this layer is strictly less than the thickness of this layer, the external layer can now contain inclusions in the form of "pavements," which seem to contain essentially silicon, the mean aluminum content of the external layer 8 is greater than the mean aluminum content of the external layer 3 of FIGS. 1, 5 or 6, and the proportion of needles and/or lamellae 9 could decrease.

For example, in FIG. 2, at p ', the highest value of this projection corresponding to the lamella or needle bearing the reference numeral 10 is represented; one can thus observe that it is considerably less than the mean thickness of the layer 8.

Without pretending to provide a definitive explanation, it is thought that the thermal treatment according to the invention generates a structural rearrangement of the external layer leading to the disappearance and/or partition of lamellae or needles of this layer.

Thus, in the case of a deformation of this sheet, the cracks which appear, for example, in the fragile internal layer of 7 of alloy, can then no longer propagate as easily in the external layer 8.

The thermal treatment according to the invention could thus have as its first technical effect the result of rearranging the structure of the external layer so as to obtain a structure which acts against the propagation of cracks.

The thermal treatment according to the invention can also be adapted to prevent or to limit the increase in the thickness of the internal layer 7 of alloy, because this layer is particularly fragile.

The conditions of the thermal treatment according to the invention can thus be optimized by those of ordinary skill in this art, between these two compromises: sufficient rearrangement of the external layer and small increase in the thickness of the internal layer of alloy.

The thermal treatment according to the invention is of short duration, which is an important advantage compared to reheating treatments which last for a long time and are carried out at a lower temperature.

The thermal treatment can thus be carried out advantageously in line on standard installations for coating with immersion.

Preferably, this thermal treatment is applied so as to heat the external layer more than the internal layer of alloy.

To proceed thus to the execution of the thermal treatment, one can use standard heating means, such as:

heating means with flame, heating means by infrared radiation, and heating means by induction, preferably at high frequency, to obtain a skin thickness which is as small as possible, that is comparable to the thickness of the external layer.

The thermal treatment according to the invention can also considerably improve the surface reflectivity of the sheet, notably in the wavelength range of 1.5–5 $\mu$m; this additional advantage is notably obtained when the thermal treatment is carried out under a nonoxidizing atmosphere.

However, in this case, it should be noted that the treatment according to the invention is not limited to a treatment of polishing the surface; indeed, some effective polishing treatments cause a considerably increase in the thickness of the internal alloy layer, which is contrary to the invention described here.

To limit the increase in the thickness of the internal layer of alloy during the thermal treatment according to the invention, it is preferred to use a steel type containing a content of free nitrogen which is larger than or equal to approximately (±20%)$10^{-2}$ wt %.

For example, steels that have been softened with aluminum and coiled at low temperature after hot lamination; by coiling at a temperature less than or equal to 610° C., the formation of aluminum nitrides (AlN) is limited, and then the content of free nitrogen is maintained at a sufficiently high level.

At the time of the application of the metallic coating to the immersed part, this free nitrogen forms phases based on aluminum nitride at the interface between the steel and the internal layer.

To limit the increase in the thickness of the internal layer of alloy during the thermal treatment according to the invention one can, before application of the coating, nitride the surface of the steel to be coated to simply carry out the reheating before immersion under an atmosphere containing ammonia.

The following non-limiting examples illustrate the invention.

EXAMPLE 1

The purpose of this example is to illustrate the invention in the case of the alumination of a steel type called "aluminum softened."

The steel sheet to be aluminum-coated according to the invention has the following analysis (contents of elements expressed in thousandths of wt %):

TABLE II

Composition of the Steel of Example 1

| Element | C | Mn | P | S | Si | Al | Ni | Cr | Cu | N |
|---|---|---|---|---|---|---|---|---|---|---|
| $10^{-3}$% | 53 | 300 | 10 | 15 | 6 | 22 | 20 | 20 | 7 | 11 |

Other elements are present in trace amounts; for example the titanium content is less than $10^{-3}$ wt %.

A large portion of the nitrogen contained in this steel is "free" nitrogen. The other part is essentially in combination with the aluminum in the form of aluminum nitride (AlN); the content of AlN was evaluated at approximately $1.4\times10^{-3}$ wt % of "nitrogen" equivalent, and from this one deduces that the content of free nitrogen is on the other of $10^{-2}$ wt % in this steel.

A coating based on aluminum, at a total thickness of approximately 15 $\mu$m, is applied to the two faces of this sheet; this coating is applied as described above to the immersed part in an aluminum bath containing silicon.

The mean content by weight of silicon in the coating is approximately 7%.

Then one applies to this aluminum coated sheet the thermal treatment according to the invention. This treatment consists in heating the sheet at the rate of 4° C./sec to a temperature of 578° C., and, as soon as this temperature is reached, in cooling by blowing nitrogen so as to obtain a cooling rate between 10 and 15° C./sec.

To perform this thermal treatment, the device which is diagrammatically represented in FIG. 4 is used; it is a vertical furnace 13 comprising two series of electrical resistances 14; the sample to be treated 15, made of aluminum coated sheet, is suspended from a support rod 16; to measure the temperature of the thermal treatment, a thermocouple 17, of type κ (chromel-alumel) is used, having a diameter of 0.2 mm, and of class 1 (±T° C.×0.004, or ±2.4° C. at 600° C.); this thermocouple 17 is welded to the coated face of the aluminum coated sheet.

After the thermal treatment, an aluminum coated sheet according to the invention is then obtained.

Metallographic observations performed on samples show that the thickness of the internal layer of alloy of the coating varied little as a result of the thermal treatment; 2.7 μm before treatment, 4 μm after treatment; this thickness thus remains less than 5 μm.

The improvement of the resistance to cracking of the coating is then characterized as described above, by counting the number of cracks opening per millimeter of fold in a metallographic cross section.

The results obtained are reported in Table III below.

Thus, one can observe that the coating according to the invention resists cracking much better than the coating according to the prior art which was not subjected to a thermal treatment.

One also observes that the internal layer of alloy is less detached by deformation after the thermal treatment according to the invention.

TABLE III

Folding Results of Example 1

| Aluminum coated sheet | Type of folding | Mean number of cracks/mm | Mean width of the cracks | Observations |
|---|---|---|---|---|
| Before thermal treatment | 0T | 10 | 40 μm | Internal layer separations and large cracks |
| | 1T | 8 | 62 μm | |
| | 2T | 5 | 7 μm | |
| | 3T | 2 | 7 μm | |
| After thermal treatement (invention) | 0T | 5 | 41 μm | No separation or little separation of the internal layer |
| | 1T | 3 | 55 μm | |
| | 2T | 0 | — | |
| | 3T | 0 | — | |

EXAMPLE 2

The purpose of this example is to illustrate the invention in the case of the alumination of a steel type called "ultra low carbon" or "ULC" ("Ultra Low Carbon" in English).

The steel sheet to be aluminum coated according to the invention has the following analysis (contents of elements expressed in thousandths of wt %):

TABLE IV

Composition of the Steel of Example 2

| Element | C | Mn | P | S | Si | Al | Ni | Cr | Cu | N |
|---|---|---|---|---|---|---|---|---|---|---|
| $10^{-3}$% | 3 | 230 | 10 | 13 | 8 | 46 | 16 | 23 | 20 | 12 |

Other elements are present in trace amounts.

One particular feature of this steel also resides in its coiling temperature at the outlet of the hot lamination: <620° C.

Because of its very low carbon content, the principle hardening agent of this steel is the free nitrogen which it contains; this steel presents, as a result, an ability to be shaped which is considerably greater than the steel described in Example 1.

This steel is aluminum coated, and then subjected to a thermal treatment according to the invention under the same conditions as in Example 1.

The result then is an aluminum coated sheet according to the invention.

As above, the metallographic observations show that the thickness of the internal layer of alloy of the coating has varied little as a result of the thermal treatment.

The improvement of the resistance to cracking of the coating is then characterized as in Example 1.

The results obtained are reported in Table V.

As above, one can observe that the coating according to the invention resists cracking much better than the coating according to the prior art which was not subjected to a thermal treatment.

TABLE V

Folding Results of Example 2

| Aluminum coated sheet | Type of folding | Mean number of cracks/mm | Mean width of the cracks |
|---|---|---|---|
| Before thermal treatment | 0T | 11 | 31 μm |
| | 1T | 8 | 28 μm |
| | 2T | 6 | 7 μm |
| | 3T | 2 | 3 μm |
| After thermal treatment (invention) | 0T | 10 | 17 μm |
| | 1T | 3 | 10 μm |
| | 2T | 1 | 3 μm |
| | 3T | <1 | 3 μm |

Based upon the above explanation, one or ordinary skill in the art is capable of making and using the invention described.

French patent application 98 02 265 is incorporated herein by reference.

What is claimed is:

1. A method for the manufacture of a steel sheet coated with a coating comprising aluminum which coating comprises two layers:

an internal layer comprising one or more alloys of iron, aluminum and optionally silicon, and an external layer consisting a phase comprising aluminum and one or more phases in the form of needles and/or elongated lamellae distributed is said phase comprising aluminum, said external layer having a thickness which is larger than or equal to that of said internal layer of alloy, said method comprising (1) applying the coating to the steel by immersion in a liquid bath, (2) solidifying said applied coating, and (3) subjecting the coated steel sheet to a thermal treatment at a temperature of more than 570° C. and less than 660° C., such that:

the thickness of the external layer remains larger than or equal to that of said internal layer, and the projection of the length of all said needles and lamellae in a direction perpendicular to the plane of said external layer is less than the thickness of the external layer, and wherein the steel of said steel has a free nitrogen content of larger than or equal to $10^{-2}$ wt %.

2. The method according to claim 1, wherein said liquid bath comprises aluminum and at least 6 wt % of silicon.

3. The method according to claim 1, wherein said liquid bath comprises aluminum and at least 8 wt % of silicon.

4. The method according to claim 1, wherein thermal treatment occurs for less than or equal to 15 sec.

5. The method according to claim 1, wherein the thermal treatment is applied so as to heat the external layer more than the internal layer.

6. A method for the shaping of a steel sheet coated with a metallic coating comprising aluminum, which coating comprises two layers:

an internal layer comprising one or more alloys of iron, aluminum and optionally silicon, an external layer which comprises a phase comprising aluminum and one or more phases in the form of needles and/or elongated lamellae distributed in said phase comprising aluminum, and having the thickness which is larger than or equal to that of the internal layer, said method comprising (1) subjecting the coated steel sheet to a thermal treatment adapted to raise the temperature of at least said external layer to above 570° C. and less than 660° C., under conditions, such that:

the thickness of said external layer remains larger than or equal to that of the internal layer, and the projection of the length of all said needles and/or lamellae in a direction perpendicular to the plane of said external layer is less than the thickness of the external layer, and (2) shaping said coated steel sheet, and wherein the steel of said steel sheet has a free nitrogen content of larger than or equal to $10^{-2}$ wt %.

7. The method according to claim 6, wherein the duration of the thermal treatment, in the phase where said temperature is larger than 570° C., is less than or equal to 15 sec.

8. The method according to claim 6, wherein the thermal treatment is applied so as to heat the external layer more than the internal layer.

9. A method for the manufacture of a steel sheet coated with a coating comprising aluminum which coating comprises two layers:

an internal layer comprising one or more alloys of iron, aluminum optionally silicon, and an external layer comprising a phase comprising aluminum and one or more phases in the form of needles and/or elongated lamellae distributed in said phase comprising aluminum, said external layer having a thickness which is larger than or equal to that of said internal layer of alloy, said method comprising (1) applying the coating to the steel by immersion in a liquid bath, (2) solidifying said applied coating, and (3) subjecting the coated steel sheet to a thermal treatment at a temperature not less than the melting temperature of a phase of the external layer corresponding to the eutectic Al—Si—Fe composition, and not more than the melting temperature of aluminum-based dendrites of the external layer, such that:

the thickness of the external layer remains larger than or equal to that of said internal layer, and the projection of the length of all said needles and lamellae in a direction perpendicular to the plane of said external layer is less than the thickness of the external layer, and wherein the steel of said steel sheet has a free nitrogen content of larger than or equal to $10^{-2}$ wt %.

10. The method according to claim 9, wherein the thermal treatment is applied so as to heat the external layer more than the internal layer.

11. A method for the manufacture of a steel sheet coated with a coating comprising aluminum which coating comprises two layers:

an internal layer comprising one or more alloy of iron, aluminum and optionally silicon, and an external layer comprising a phase comprising aluminum and one or more phases in the form of needles and/or elongated lamellae distributed in said phase comprising aluminum, said external layer having a thickness which is larger than or equal to that of said internal layer of alloy.

said method comprising (1) applying the coating to the steel sheet by immersion in a liquid bath, (2) solidifying said applied coating, and (3) subjecting the coated steel sheet to a thermal treatment at a temperature of more than 570° C. and less than 660° C., such that:

the thickness of the external layer remains larger than or equal to that of said internal layer, and the projection of the length of all said needles and lamellae in a direction perpendicular to the plane of said external layer is less than the thickness of the external layer, and wherein the duration of the thermal treatment, in the phase where the temperature is larger than 570° C., is less than or equal to 15 sec.

12. The method according to claim 11, wherein said liquid bath comprises aluminum and at least 6 wt % of silicon.

13. The method according to claim 11, wherein said liquid bath comprises aluminum and at least 8 wt % of silicon.

14. The method according to claim 11, wherein the thermal treatment is applied so as to heat the external layer more than the internal layer.

15. A method for the shaping of a steel sheet coated with a metallic coating comprising aluminum, which coating comprises two layers:

an internal layer comprising one or more alloys or iron, aluminum and optionally silicon, an external layer which comprises a phase comprising aluminum and one or more phases in the form of needles and/or elongated lamellae distributed in said phase comprising aluminum, and having a thickness which is larger than or equal to that of the internal layer, said method comprising (1) subjecting the coated steel sheet to a thermal treatment adapted to raise the temperature of at least said external layer to above 570° C. and less than 660° C., under conditions, such that:

the thickness of said external layer remains larger than or equal to that of the internal layer, and the projection of the length of all said needles and/or lamellae in a direction perpendicular to the plane of said external layer is less than the thickness of the external layer, and (2) shaping said coated steel sheet, and wherein the duration of the thermal treatment, in the phase where the temperature is larger than 570° C., is less than or equal to 15 sec.

16. The method according to claim 15, wherein the thermal treatment is applied so as to heat the external layer more than the internal layer.

17. A method for the manufacture of a steel sheet coated with a coating comprising aluminum which coating comprises two layers:

an internal layer comprising one or more alloys of iron, aluminum and optionally silicon, and an external layer comprising a phase comprising aluminum and one or more phases in the form of needles and/or elongated lamellae distributed in said phase comprising aluminum, said external layer having a thickness which is larger then or equal to that of said internal layer of alloy, said method comprising (1) applying the coating to the steel sheet by immersion in a liquid bath, (2) solidifying said applied coating, and (3) subjecting the coated steel sheet to a thermal treatment at a temperature not less than the melting temperature of a phase of the external layer corresponding to the eutectic Al—Si—Fe composition, and not more than the melting temperature of aluminum-based dendrites of the external layer, such that:

the thickness of the external layer remains larger than or equal to that of said internal layer, and the projection of the length of all said needles and lamellae in a direction perpendicular to the plane of said external layer is less than the thickness of the external layer, and wherein the duration of the thermal treatment, in the phase where the temperature is larger than 570° C., is less than or equal to 15 sec.

18. The method according to claim 17, wherein the thermal treatment is applied so as to heat the external layer more than the internal layer.

* * * * *